US008686303B2

(12) United States Patent
Chen et al.

(10) Patent No.: US 8,686,303 B2
(45) Date of Patent: Apr. 1, 2014

(54) THIN FILM SWITCH AND PRESS KEY/KEYBOARD USING THE SAME

(75) Inventors: Ming-Hong Chen, Taichung (TW); Po-Chun Hou, Taipei (TW); Chih-Hung Chen, Kaohsiung (TW)

(73) Assignee: Darfon Electronics Corp., Taoyuan County (TW)

( * ) Notice: Subject to any disclaimer, the term of this patent is extended or adjusted under 35 U.S.C. 154(b) by 146 days.

(21) Appl. No.: 13/457,543

(22) Filed: Apr. 27, 2012

(65) Prior Publication Data

US 2013/0134023 A1 May 30, 2013

(30) Foreign Application Priority Data

Nov. 29, 2011 (TW) ..... 100222560 A
Dec. 13, 2011 (TW) ..... 100223507 A

(51) Int. Cl.
*H01H 9/26* (2006.01)

(52) U.S. Cl.
USPC ..... 200/5 A

(58) Field of Classification Search
USPC ..... 200/5 A, 517, 530, 344, 310–314, 341, 200/345, 340, 510–515
See application file for complete search history.

(56) References Cited

U.S. PATENT DOCUMENTS 4,701,579 A * 10/1987 Kurachi et al. ..... 200/5 A
6,747,402 B2 * 6/2004 Hato et al. ..... 313/305
6,960,733 B2 * 11/2005 Hanahara et al. ..... 200/314

* cited by examiner

*Primary Examiner* — Edwin A. Leon
(74) *Attorney, Agent, or Firm* — WPAT, PC; Justin King

(57) ABSTRACT

A thin film switch, comprising: a first thin film, having a first conductor unit mounted thereon; and a second thin film, having a second conductor unit mounted on a surface thereof facing toward the first thin film; wherein, the first conductor unit is composed of at least one first electric conductor; and the second conductor is composed of a plurality of second electric conductors to be arranged in a manner that one of the plural second electric conductors is disposed at a first position defined on the second thin film while designating another one of the plural second electric conductors to be disposed at a second position of the second thin film. Operationally, the thin film switch is capable of outputting different signals in response to different forces exerted thereon for triggering different electric conductors mounted on different positions in the thin film switch.

25 Claims, 4 Drawing Sheets

THIN FILM SWITCH AND PRESS KEY/KEYBOARD USING THE SAME

FIELD OF THE INVENTION

The present invention relates to a thin film switch adapted for a press-key or a keyboard, and more particularly, to a thin film switch capable of outputting different signals in response to different forces exerted thereon for triggering different electric conductors mounted on different positions in the thin film switch.

BACKGROUND OF THE INVENTION

With rapid advance in thin film technology, thin film switch is becoming smaller, lighter and thinner that it is vastly used in all kinds of electronic devices. Moreover, since it will not generate loud noise while being pressed, it is especially suitable to be used in press keys or keyboards.

Generally, a conventional thin film switch is primarily composed of two thin films, in that there are two electric conductors disposed respectively on the opposite surfaces of the two thin films at positions corresponding to each other so as to work cooperatively as an electrical switch. That is, by connecting each of the two electric conductors to a circuit formed on its corresponding thin film, an abrupt electrical signal can be produced as soon as the thin film switch is subjected to a normal load for enabling the two electric conductors to engage with each other. Taking a conventional press key using thin film switch for example, it is configured with only one pair of such electric conductors at a position directly corresponding to its keycap. Thereby, when the keycap is subjected to a normal load, the pair of the electric conductors will be forced to engage with each other for producing an electrical signal, i.e. the switch composed of the two electric conductors is triggered. Similarly, for those keyboard composed of a plurality of press key using such thin film switches, the thin film switch of two corresponding electric conductor in each press key can be triggered to produce only one electrical signal as soon as the referring press key is subjected to a normal load. Therefore, when such keyboard is used as a human machine interface for controlling movements of a figure in a computer game operating on a personal computer, the figure can only be directed to perform different movements by pressing different keys on the keyboard. That is, for directing the figure to move continuously upward, downward, to the left and finally to the right, the user must presses on four different keys on the keyboard just for doing so, which can be a tedious and troublesome operation.

SUMMARY OF THE INVENTION

In view of the disadvantages of prior art, the primary object of the present invention is to provide a thin film switch capable of outputting different signals in response to different forces exerted thereon for triggering different electric conductors mounted on different positions in the thin film switch.

To achieve the above object, the present invention provides a thin film switch, comprising:

- a first thin film, having a first conductor unit mounted on a surface thereof; and
- a second thin film, disposed corresponding to the surface of the first thin film where the first conductor unit is mounted while allowing the second thin film to be spaced from the first thin film by a first interval, and having a second conductor unit mounted on a surface of the second thin film that is facing toward the first thin film;

wherein, the first conductor unit is spaced from the second conductor unit by a second interval; the first conductor unit is composed of at least one first electric conductor; and the second conductor is composed of a plurality of second electric conductors, that are arranged in a manner that one of the plural second electric conductors is disposed at a first position defined on the second thin film while designating another one of the plural second electric conductors to be disposed at a second position of the second thin film, which enabling the first position to be spaced from the second position by a first distance, and thereby, the at least one first electric conductor is enabled to engage with the second electric conductor at the first position for constructing an electrical conduction when a first force is exerted upon the thin film switch for causing the first thin film and the second thin film to move toward each other, and the at least one first electric conductor is enabled to engage simultaneously with the second electric conductors at the first and the second positions for constructing another electrical conduction when a second force is exerted upon the thin film switch for causing the first thin film and the second thin film to move toward each other.

In another embodiment, the present invention further provides a press key using thin film switch, which comprises:

- a substrate;
- a thin film switch, disposed at a side of the substrate, and further comprising:
  - a first thin film, having a first conductor unit that is composed of at least one first electric conductor and is mounted on a surface of the first thin film; and
  - a second thin film, disposed corresponding to the surface of the first thin film where the at least one first electric conductor is mounted while allowing the second thin film to be spaced from the first thin film by a first interval, the second thin film further having a second conductor unit, composed of a plurality of second electric conductors, that is mounted on a surface of the second thin film which is orientated facing toward the first thin film and at a position corresponding to the first conductor unit while allowing the first conductor unit to be spaced from the second conductor unit by a second interval, and the plural second electric conductors being arranged in a manner that one of the plural second electric conductors is disposed at a first position defined on the second thin film while designating another one of the plural second electric conductors to be disposed at a second position of the second thin film, and simultaneously enabling the first position to be spaced from the second position by a first distance;
- a keycap, disposed corresponding to a side of the thin film switch that is not engaged with the substrate;
- an elastic component, disposed at a position between the keycap and the substrate, further having a protrusion with a central axis line to be formed at a position corresponding to the at least one first electric conductor; and
- a supporting element, disposed at a position between the keycap and the substrate while movably connecting to the keycap and the substrate for enabling the keycap to move up and down relative to the substrate;

wherein, the at least one first electric conductor is enabled to engage with the second electric conductor at the first position for constructing an electrical conduction when a first force is exerted upon the keycap for causing the protrusion to move along its central axis line and thus engage with the thin film switch so as to enable the first thin film and the second thin film to move toward each other, and the at least one first electric conductor is enabled to engage simultaneously with the second electric conductors at the first and the second positions for constructing another electrical conduction when a second force is exerted upon the keycap for causing the protrusion to move along its central axis line and thus engage with the thin film switch so as to enable the first thin film and the second thin film to move toward each other.

In another embodiment, the present invention further provides a keyboard using thin film switch, which comprises:

a substrate;

a thin film switch, disposed at a side of the substrate, and further comprising:

a first thin film, having a plurality of first conductor units that are respectively composed of at least one first electric conductor and are mounted on a surface of the first thin film; and a second thin film, disposed corresponding to the surface of the first thin film where the at least one first electric conductor is mounted while allowing the second thin film to be spaced from the first thin film by a first interval, the second thin film further having a plurality of second conductor units, each composed of a plurality of second electric conductors, to be mounted on a surface of the second thin film that is orientated facing toward the first thin film and at positions corresponding to the plural first conductor units corresponding respectively thereto, and the plural second electric conductors being arranged in a manner that one of the plural second electric conductors is disposed at a first position defined on the second thin film while designating another one of the plural second electric conductors to be disposed at a second position of the second thin film, and simultaneously enabling the first position to be spaced from the second position by a first distance;

a plurality of keycaps, disposed corresponding to a side of the thin film switch that is not engaged with the substrate;

a plurality of elastic components, each disposed at a position between the keycap corresponding thereto and the substrate, and each further having a protrusion with a central axis line to be formed at a position corresponding to the at least one first electric conductor of one of the plural first conductor units corresponding thereto; and a plurality of supporting elements, each disposed at a position between the keycap corresponding thereto and the substrate while movably connecting to the keycap corresponding thereto and the substrate for enabling the corresponding keycap to move up and down relative to the substrate;

wherein, when one of the plural keycap is subjected to a first force, the protrusion of the pressed keycap is enabled to move along its central axis line and thus engage with the thin film switch so as to enable the first thin film and the second thin film to move toward each other, and thus enable the at least one first electric conductor of the first conductor unit that is disposed corresponding to the pressed keycap to engage with the second electric conductor at the first position for constructing an electrical conduction, and when one of the plural keycap is subjected to a second force, the protrusion of the pressed keycap is enabled to move along its central axis line and thus engage with the thin film switch so as to enable the first thin film and the second thin film to move toward each other, and thus enable the at least one first electric conductor of the first conductor unit that is disposed corresponding to the pressed keycap to engage simultaneously with the second electric conductors at the first and the second positions of one corresponding second conductor unit for constructing another electrical conduction.

Further scope of applicability of the present application will become more apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given herein below and the accompanying drawings which are given by way of illustration only, and thus are not limitative of the present invention and wherein.

DESCRIPTION OF THE EXEMPLARY EMBODIMENTS

Figure 1:
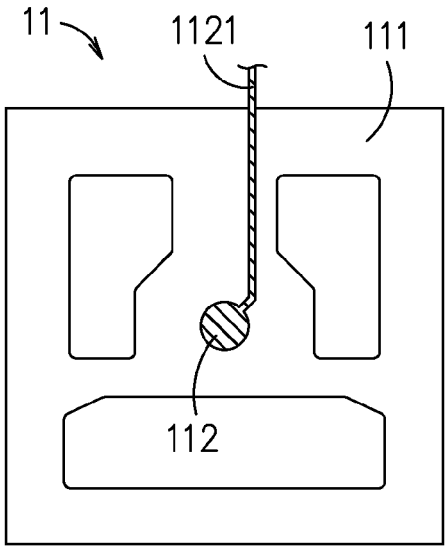
FIG. 1 is a schematic diagram showing a first thin film used in a thin film switch according to a first embodiment of the present invention.
Figure 2:
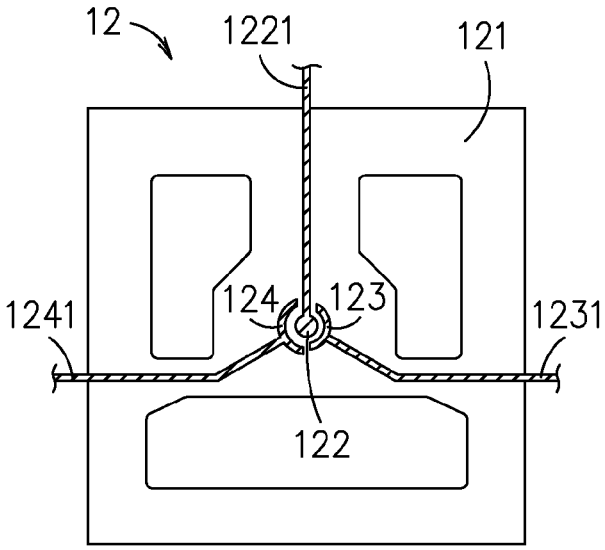
FIG. 2 is a schematic diagram showing a second thin film used in the thin film switch according to the first embodiment of the present invention.
Figure 3:
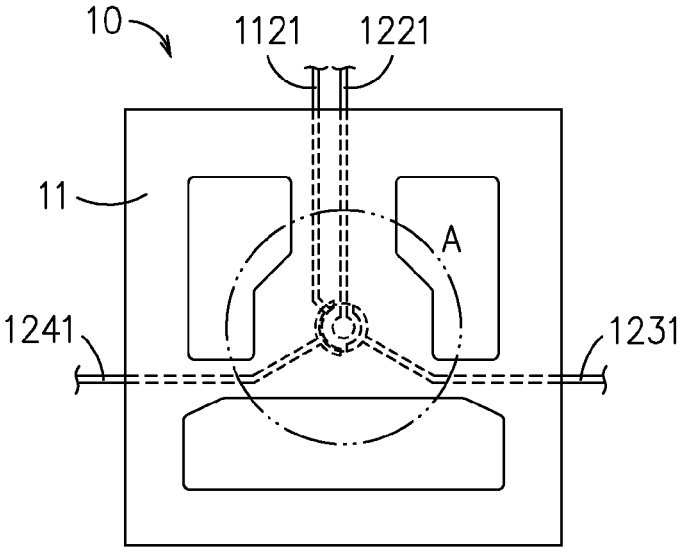
FIG. 3 is a schematic diagram showing an assembly of a thin film switch including a first thin film and a second thin film according to an embodiment of the invention.
Figure 4:
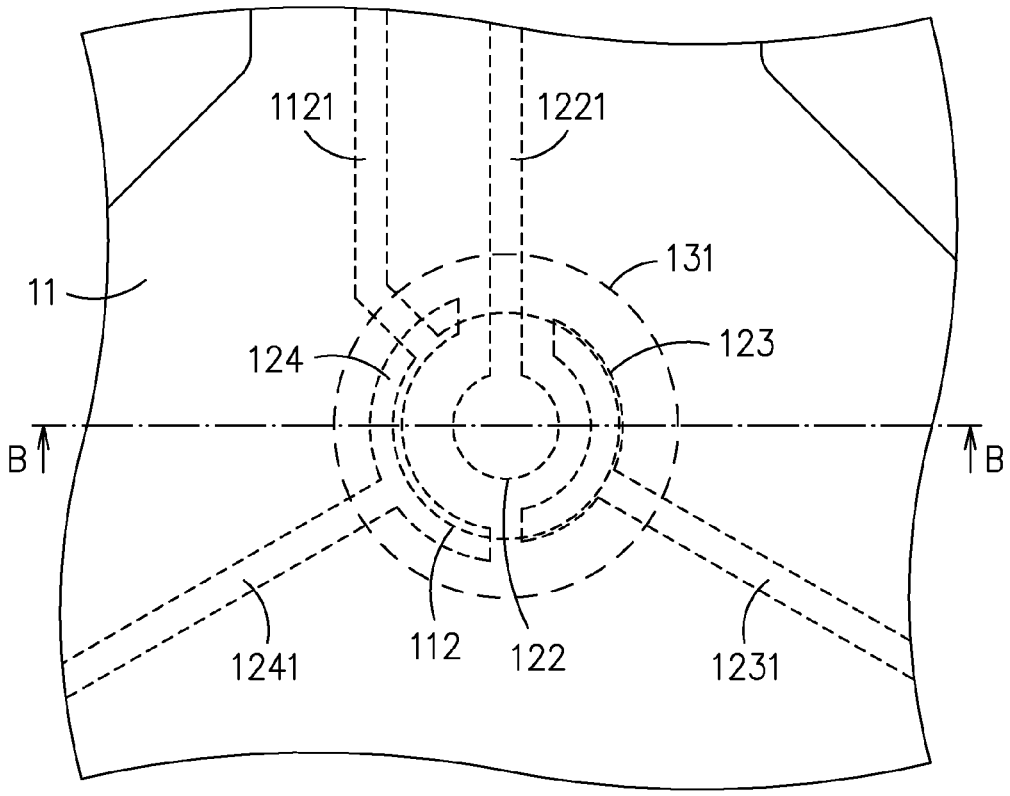
FIG. 4 is an enlarged view showing the A-area indicated in FIG. 3.

For your esteemed members of reviewing committee to further understand and recognize the fulfilled functions and structural characteristics of the invention, several exemplary embodiments cooperating with detailed description are presented as the follows.

As shown in FIG. 1 to FIG. 5, the thin film switch 10 of the present invention is composed of a first thin film and a second thin film 12. Moreover, there is a first conductor unit that is mounted on a surface 111 of the first thin film 11 and is composed of a first electric conductor 112; and the second thin film 12 is disposed corresponding to the surface 111 of the first thin film 11 where the first electric conductor 112 is mounted, and also the second thin film 12 has a second conductor unit to be mounted on a surface 121 of the second thin film 12 that is orientated facing toward the first thin film 11, whereas the second conductor unit is composed of a plurality of second electric conductors, i.e. the three second electric conductors 122, 123, and 124 shown in FIG. 2. In this embodiment, one of the plural second electric conductors, i.e. the second electric conductor 122, is disposed at a first position defined on the second thin film 12 while designating another one of the plural second electric conductors, i.e. the second electric conductor 123, to be disposed at a second position of the second thin film 12, and simultaneously designating further another one of the plural second electric conductors, i.e. the second electric conductor 124, to be disposed at a third position of the second thin film 12. In this embodiment, the second electric conductor disposed at the first position, i.e. the second electric conductor 122, is a circular-shaped component, while the second electric conductors disposed at the second and the third positions, i.e. the second electric conductors 123 and 124, are both arc-shaped component, and thereby, the two arc-shaped second electric conductors 123, 124 are arranged concentric to the circular-shaped second electric conductor 122. Moreover, there are circuits 1121, 1221, 1231, 1241 formed respectively on the first and the second thin films 11, 12 that are disposed connecting to the first electric conductor 112, and the second electric conductors 122, 123, 124 in respective.

Figure 5:
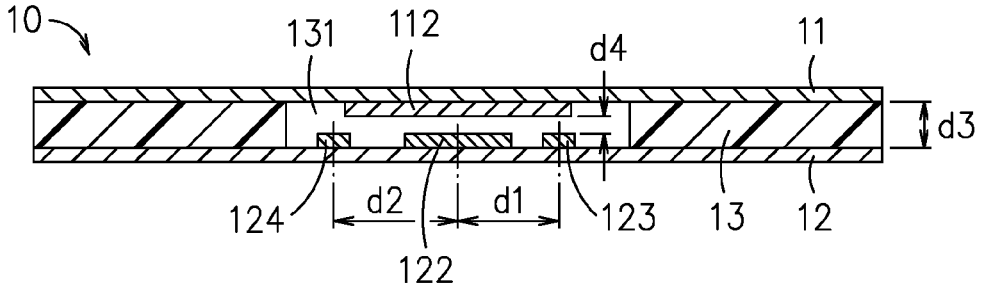
FIG. 5 is a B-B cross sectional view of FIG. 4.

The surface 111 of the first thin film 11 where the first electric conductor 112 and the circuit 1121 are disposed in orientated facing toward the surface 121 of the second thin film 12 where the second electric conductors 122, 123, 124 and the circuits 1221, 1231, 1241 are disposed. In addition, the thin film switch 10 further has a spacer layer 13, which is formed with a hole 131 and is disposed between the first and the second thin films 11, 12, as shown in FIG. 5. In FIG. 5, the first thin film 11, the spacer layer 13 and the second thin film 12 constitute a three-layered structure, in which the plural second electric conductors 122, 123, 124 are disposed distributing within an area on the second thin film 12 that is corresponding to the first electric conductor 112 mounted on the first thin film, while allowing the first electric conductor 112 as well as the second electric conductors 122, 123, 124 to be received inside the hole 131. Moreover, in this embodiment, the second electric conductor 122 that is disposed at the first position is spaced from the second electric conductor 123 that is disposed at the second position by a first distance d1, and simultaneously, the second electric conductor 122 that is disposed at the first position is spaced from the second electric conductor 124 that is disposed at the third position by a first distance d2, and the first distance d1 is not equal to the second distance d2. In addition, as the first thin film 11 is spaced from the second thin film 12 by an interval d3, the plural second electric conductors 122, 123, 124 will be spaced from the first electric conductor 112 by another interval d4 and thus the second electric conductors 122, 123, 124 are physically separated from electrically connecting to the first electric conductor 112 when the thin film switch 10 is not being subjected to a normal load, as shown in FIG. 5.

Obviously, it is not necessary for the first thin film 11 to be disposed on top of the second thin film 12 as shown in the embodiment of FIG. 1 to FIG. 5, so that the second thin film 12 along with the plural second electric conductors 122, 123, 124 and the circuits 1221, 1231, 1241 can be used as an upper layer while the first thin film 11 along with the first electric conductor 112 and the circuit 1121 can be used as the bottom layer in the thin film switch 10.

Figure 6:
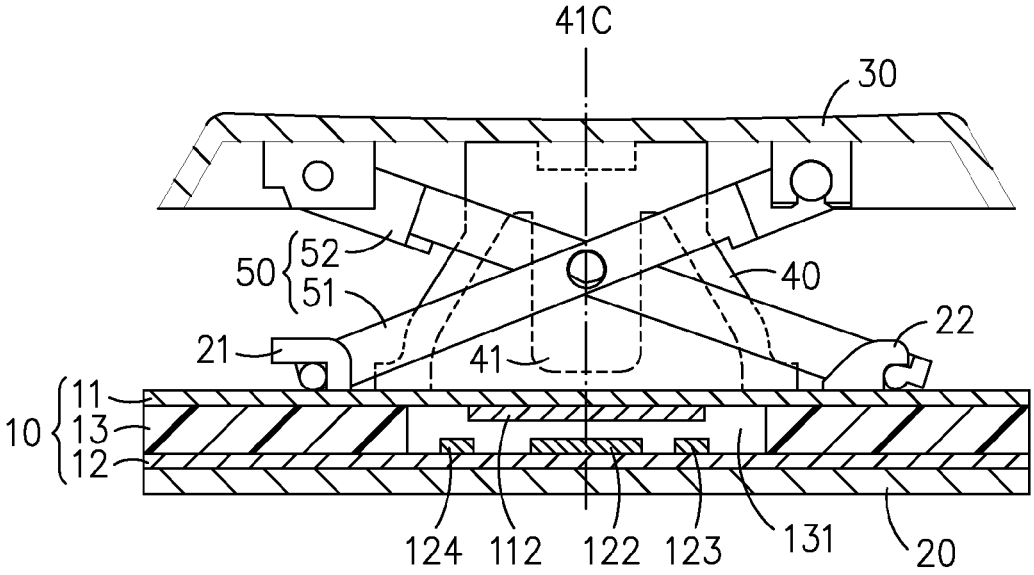
FIG. 6 is a side view of a press key using a thin film switch of the invention.

Please refer to FIG. 6, which is a side view of a press key using a thin film switch of the invention. In FIG. 6, the press key is composed of: a thin film switch 10, a substrate 20, a keycap 30, an elastic component 40 and a supporting element 50, in which the thin film switch 10 is disposed at a side of the substrate 20; the keycap 30 is disposed corresponding to a side of the thin film switch 10 that is not engaged with the substrate 20; and the elastic component 40 is disposed at a position between the keycap 30 and the substrate 20, i.e. between the keycap 30 and the thin film switch 10. In this embodiment, the thin film switch 10 is disposed on the top side of the substrate 20, and the keycap 30 is disposed on top of the thin film switch 10, while allowing the elastic component 40 to be sandwiched between the keycap 30 and the substrate 20.

In the embodiment shown in FIG. 6, the thin film switch 10 is constructed structurally the same as the one shown in FIG. 5, which is also composed of a first thin film 11, a spacer layer 13, and a second thin film 12. Similarly, the first thin film 11 has a first conductor unit mounted thereon, whereas the first conductor unit is composed of a first electric conductor 111; the second thin film 12 has a second conductor unit mounted thereon, whereas the second conductor unit is composed of three second electric conductors 122, 123, 124; and the space layer 13, that is sandwiched between the first and the second thin films 11, 12, is formed with a hole 131 at a position corresponding to the first electric conductor 111 and the three second electric conductors 122, 123, 124.

Generally, the substrate 20 is made of a metal, which is configured with two upward-extending hooks 21, 22 that are arranged piecing the thin film switch 10 so as to be used for fastening and thus fixedly securing the supporting element 50. The keycap 30 is disposed above the substrate. The elastic component 40, that is generally made of a rubber, is formed with a protrusion 41 at a side thereof facing toward the thin film switch 10 while allowing the protrusion 41 to be positioned corresponding to the first electric conductor 112. Moreover, the protrusion 41 is formed with a central axis line at a position for enabling the central axis line to pass through the center of the circular-shaped second electric conductor 122 that is disposed at the first position.

In this embodiment, the supporting element 50 can substantially be a scissors-type supporting part, configured by the use of a first and a second pivot axes 51, 52 that are coupled to each other while enabling one end of the first pivot axis 51 to be moveably couple to the keycap 30 and another end of the first pivot axis opposite thereto to moveably coupled to one of the two hooks 21 formed on the substrate 20, and simultaneously enabling one end of the second pivot axis 52 to be moveably coupled to the keycap 30 and another end of the second pivot axis 52 opposite thereto to be moveably coupled to another hook 22 on the substrate 20; and thereby, the elastic component 40 is received inside the scissors-type supporting part 50. It is noted that the supporting element 50 is arranged at a position between the keycap 30 and the substrate 20 while movably connecting to the keycap 30 and the substrate 20 for enabling the keycap 30 to move up and down relative to the substrate 20, i.e. relative to the thin film switch 10.

Figure 7:
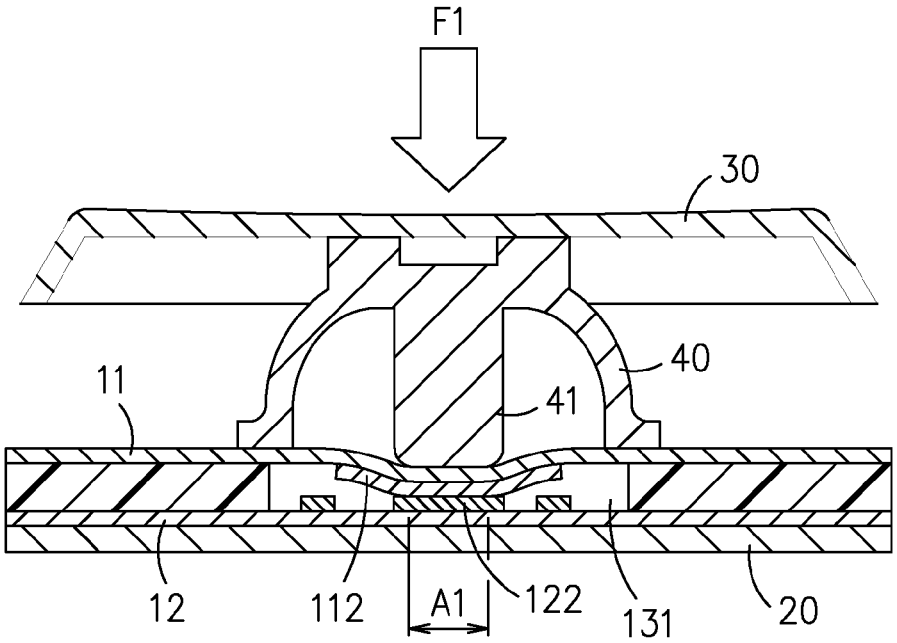
FIG. 7 to FIG. 9 are schematic diagrams showing how a press key is enables to output different signals simply by exerting different forces upon its keycap for triggering a different electric conductors located at different positions in a thin film switch under the keycap.

When the keycap 30 is being pressed by a first force F1, as shown in FIG. 7, the protrusion 41 is being forced to move downward and press on the first thin film 11, causing the first thin film 11 and the protrusion 41 to deformed while allowing the two to contact with each other with a first contact area A1. While the first thin film 11 is being pressed and deformed by the protrusion 41, the portion of the first thin film that is being pressed by the protrusion 41, whose area is in direct proportion to the first contact area A1, is actually being driven to move toward the second thin film 12 as the second thin film 12 is being supported by the substrate 20, and consequently, the first electric conductor 112 can be forced to engage with the second electric conductor 122 that is disposed at the first position for enabling an electrical conduction so as to trigger a first signal to be emitted through the circuits 1121 and 1221 that are connected respectively to the first electric conductor 112 and the second electric conductor 122.

Figure 8:
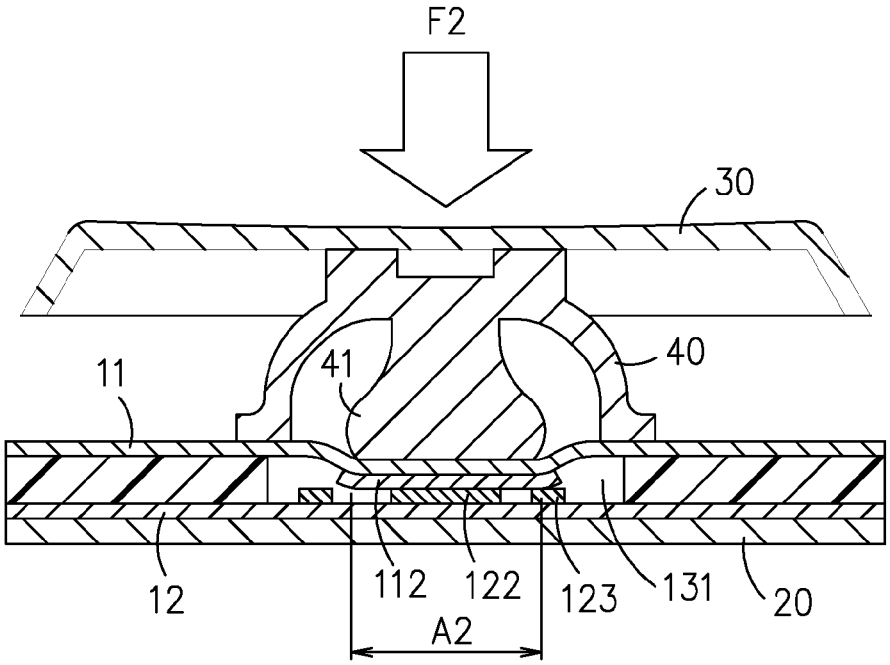

When the keycap 30 is being pressed by a second force F2 that is larger than the first force F1, as shown in FIG. 8, the protrusion 41 also is being forced to move downward and press on the first thin film 11, causing the first thin film 11 and the protrusion 41 to deformed comparatively larger than that disclosed in FIG. 7, while allowing the two to contact with each other with a second contact area A2 that is larger than the first contact area A1. While the first thin film 11 is being pressed and deformed by the protrusion 41, the portion of the first thin film that is being pressed by the protrusion 41, whose area is in direct proportion to the second contact area A2 that is comparatively larger, is actually being driven to move toward the second thin film 12 as the second thin film 12 is being supported by the substrate 20, and consequently, the first electric conductor 112 can be forced to engage with the second electric conductors 122 and 123 that are disposed at the first and the second positions for enabling another electrical conduction so as to trigger a second signal to be emitted through the circuits 1121, 1221 and 1231 that are connected respectively to the first electric conductor 112 and the second electric conductors 122, 123.

Figure 9:
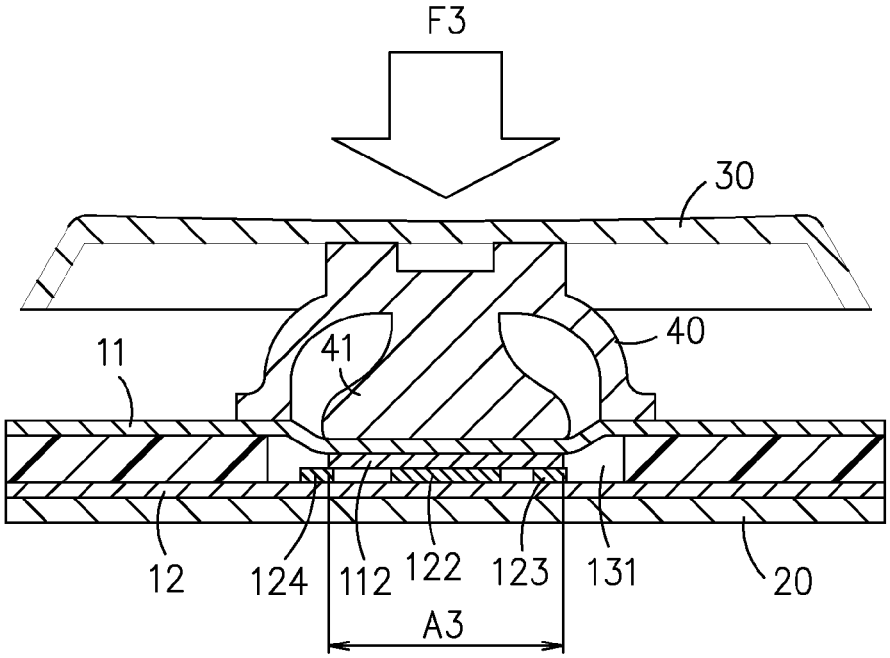

When the keycap 30 is being pressed by a third force F3 that is larger than the first force F1 and the second force F2, as shown in FIG. 9, the protrusion 41 also is being forced to move downward and press on the first thin film 11, causing the first thin film 11 and the protrusion 41 to deformed comparatively larger than those disclosed in FIG. 7 and FIG. 8, while allowing the two to contact with each other with a third contact area A3 that is larger than the first contact area A1 and the second contact area A2. While the first thin film 11 is being pressed and deformed by the protrusion 41, the portion of the first thin film that is being pressed by the protrusion 41, whose area is in direct proportion to the third contact area A3 that is comparatively larger, is actually being driven to move toward the second thin film 12 as the second thin film 12 is being supported by the substrate 20, and consequently, the first electric conductor 112 can be forced to engage with the second electric conductors 122, 123 and 124 that are disposed at the first, the second and the third positions for enabling further another electrical conduction so as to trigger a third signal to be emitted through the circuits 1121, 1221, 1231 and 1241 that are connected respectively to the first electric conductor 112 and the second electric conductors 122, 123, 124.

As shown in FIG. 7 to FIG. 9, it is noted that by controlling the magnitude of force that is being exerted on the keycap 30, the first electric conductor 112 can be forced to move downward toward the plural second electric conductors 122, 123, 124 at different levels for allowing the same to engage with different sets of second electric conductors 122, 123, 124, since the second electric conductors 122, 123, 124 are positioned at different distances away from the center of the portion of the first thin film 11 that is being pressed, deformed and moved toward the second thin film 12, and thereby, there can be different signals to be triggered and emitted simply corresponding to the magnitude of force that is being exerted. For instance, if there are three such second electric conductors 122, 123, and 124 that are disposed at the first, the second and the third positions on the second thin film 12, it is possible to trigger three different signals simply by exerting different forces upon the same thin film switch 10, and consequently, if there are only two such second electric conductors 122, and 123 that are disposed at the first and the second positions on the second thin film 12, there can only be two different signals being triggered by the same thin film switch 10. In addition, if there are four such second electric conductors that are disposed at different positions on the second thin film 12, there can be four different signals being triggered by the same thin film switch 10. In addition, it is noted that the first conductor unit, that is disposed on the first thin film 11, can be composed of a plurality of first electric conductors, and the amount of the first electric conductors in the first conductor unit is equal to that of the second electric conductors on the second thin film 12, and the plural first electric conductors are disposed at positions corresponding to the plural second electric conductors in an one-on-one manner.

To sum up, the present invention provides a thin film switch, that is capable of outputting different signals in response to different forces exerted thereon for triggering different electric conductors mounted on different positions in the thin film switch. That is, with the aforesaid structure, it is possible to trigger and emit different signals simply by exerting different forces upon the same thin film switch of the present invention.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

What is claimed is:

1. A thin film switch, comprising:

a first thin film, having a first conductor unit mounted on a surface thereof; and a second thin film, disposed corresponding to the surface of the first thin film where the first conductor unit is mounted while allowing the second thin film to be spaced from the first thin film by a first interval, and having a second conductor unit mounted on a surface of the second thin film that is facing toward the first thin film;

wherein, the first conductor unit is spaced from the second conductor unit by a second interval; the first conductor unit is composed of at least one first electric conductor; and the second conductor is composed of a plurality of second electric conductors, that are arranged in a manner that one of the plural second electric conductors is disposed at a first position defined on the second thin film while designating another one of the plural second electric conductors to be disposed at a second position of the second thin film, meanwhile, enabling the first position to be spaced from the second position by a first distance, and thereby, the at least one first electric conductor is enabled to engage with the second electric conductor at the first position for constructing an electrical conduction when a first force is exerted upon the thin film switch for causing the first thin film and the second thin film to move toward each other, and the at least one first electric conductor is enabled to engage simultaneously with the second electric conductors at the first and the second positions for constructing another electrical conduction when a second force is exerted upon the thin film switch for causing the first thin film and the second thin film to move toward each other.

2. The thin film switch of claim 1, wherein in addition to the second electric conductors that are disposed respectively at the first and the second positions on the second thin film, there is further another second electric conductor that is selected from the plural second conductors of the second conductor unit to be disposed at a third position on the second thin film while enabling the third position to be spaced from the first position by a second distance that is not equal to the first distance; and thereby, the at least one first electric conductor is enabled to engage simultaneously with the second electric conductors at the first, the second and the third positions for constructing further another electrical conduction when a third force is exerted upon the thin film switch for causing the first thin film and the second thin film to move toward each other.

3. The thin film switch of claim 2, wherein the second electric conductor disposed at the first position is a circular-shaped component, while the second electric conductors disposed at the second and the third positions are both arc-shaped component, and thereby, the two arc-shaped second electric conductors are arranged concentric to the circular-shaped second electric conductor.

4. The thin film switch of claim 1, wherein the plural second electric conductors are disposed distributing within an area on the second thin film that is corresponding to the at least one first electric conductor of the first conductor unit mounted on the first thin film.

5. The thin film switch of claim 1, wherein the amount of the first electric conductors in the first conductor unit is equal to that of the second electric conductors, and the plural first electric conductors are disposed corresponding to the plural second electric conductors in an one-on-one manner.

6. The thin film switch of claim 1, wherein the first and the second thin films are respectively being formed with circuits, that can be electrically conducted as soon as the at least one first electric conductor is enabled to engaged with the plural second electric conductors.

7. The thin film switch of claim 1, further comprising:

a spacer layer, arranged between the first thin film and the second thin film, having a hole formed thereon to be used for allowing the at least one first electric conductor to cross therethrough so as to engage with the plural second electric conductors for construction the electrical conduction when the first thin film and second thin film are forced to move toward each other.

8. A press key using thin film switch, comprising:

a substrate;

a thin film switch, disposed at a side of the substrate, and further comprising:

a first thin film, having a first conductor unit that is composed of at least one first electric conductor and is mounted on a surface of the first thin film; and a second thin film, disposed corresponding to the surface of the first thin film where the at least one first electric conductor is mounted while allowing the second thin film to be spaced from the first thin film by a first interval, the second thin film further having a second conductor unit, composed of a plurality of second electric conductors, that is mounted on a surface of the second thin film which is orientated facing toward the first thin film and at a position corresponding to the first conductor unit while allowing the first conductor unit to be spaced from the second conductor unit by a second interval, and the plural second electric conductors being arranged in a manner that one of the plural second electric conductors is disposed at a first position defined on the second thin film while designating another one of the plural second electric conductors to be disposed at a second position of the second thin film, and simultaneously enabling the first position to be spaced from the second position by a first distance;

a keycap, disposed corresponding to a side of the thin film switch that is not engaged with the substrate;

an elastic component, disposed at a position between the keycap and the substrate, further having a protrusion with a central axis line to be formed at a position corresponding to the at least one first electric conductor; and a supporting element, disposed at a position between the keycap and the substrate while movably connecting to the keycap and the substrate for enabling the keycap to move up and down relative to the substrate;

wherein, the at least one first electric conductor is enabled to engage with the second electric conductor at the first position for constructing an electrical conduction when a first force is exerted upon the keycap for causing the protrusion to move along its central axis line and thus engage with the thin film switch so as to enable the first thin film and the second thin film to move toward each other, and the at least one first electric conductor is enabled to engage simultaneously with the second electric conductors at the first and the second positions for constructing another electrical conduction when a second force is exerted upon the keycap for causing the protrusion to move along its central axis line and thus engage with the thin film switch so as to enable the first thin film and the second thin film to move toward each other.

9. The press key of claim 8, wherein in addition to the second electric conductors that are disposed respectively at the first and the second positions on the second thin film, there is further another second electric conductor that is selected from the plural second conductors of the second conductor unit to be disposed at a third position on the second thin film while enabling the third position to be spaced from the first position by a second distance that is not equal to the first distance; and thereby, the at least one first electric conductor is enabled to engage simultaneously with the second electric conductors at the first, the second and the third positions for constructing further another electrical conduction when a third force is exerted upon the thin film switch for causing the first thin film and the second thin film to move toward each other.

10. The press key of claim 9, wherein the second electric conductor disposed at the first position is a circular-shaped component, while the second electric conductors disposed at the second and the third positions are both arc-shaped component, and thereby, the two arc-shaped second electric conductors are arranged concentric to the circular-shaped second electric conductor.

11. The press key of claim 10, wherein the central axis line of the elastic component is arranged passing through the center of the circular-shaped second electric conductor.

12. The press key of claim 8, wherein the plural second electric conductors are disposed distributing within an area on the second thin film that is corresponding to the at least one first electric conductor of the first conductor unit mounted on the first thin film.

13. The press key of claim 8, wherein the amount of the first electric conductors in the first conductor unit is equal to that of the second electric conductors, and the plural first electric conductors are disposed corresponding to the plural second electric conductors in an one-on-one manner.

14. The press key of claim 8, wherein the first and the second thin films are respectively being formed with circuits, that can be electrically conducted as soon as the at least one first electric conductor is enabled to engaged with the plural second electric conductors.

15. The press key of claim 8, further comprising:

a spacer layer, arranged between the first thin film and the second thin film, having a hole formed thereon to be used for allowing the at least one first electric conductor to cross therethrough so as to engage with the plural second electric conductors for construction the electrical conduction when the first thin film and second thin film are forced to move toward each other.

16. The press key of claim 8, wherein the supporting element is substantially a scissors-type supporting part, configured by the use of a first and a second pivot axes that are coupled to each other while enabling one end of the first pivot axis to be moveably coupled to the keycap and another end of the first pivot axis opposite thereto to be moveably coupled to the substrate, and simultaneously enabling one end of the second pivot axis to be moveably coupled to the keycap and another end of the second pivot axis opposite thereto to be moveably coupled to the substrate; and thereby, the elastic component is received inside the scissors-type supporting part.

17. A keyboard using thin film switch, comprising:

a substrate;

a thin film switch, disposed at a side of the substrate, and further comprising:

a first thin film, having a plurality of first conductor units that are respectively composed of at least one first electric conductor and are mounted on a surface of the first thin film; and a second thin film, disposed corresponding to the surface of the first thin film where the at least one first electric conductor is mounted while allowing the second thin film to be spaced from the first thin film by a first interval, the second thin film further having a plurality of second conductor units, each composed of a plurality of second electric conductors, to be mounted on a surface of the second thin film that is orientated facing toward the first thin film and at positions corresponding to the plural first conductor units corresponding respectively thereto, and the plural second electric conductors being arranged in a manner that one of the plural second electric conductors is disposed at a first position defined on the second thin film while designating another one of the plural second electric conductors to be disposed at a second position of the second thin film, and simultaneously enabling the first position to be spaced from the second position by a first distance;

a plurality of keycaps, disposed corresponding to a side of the thin film switch that is not engaged with the substrate;

a plurality of elastic components, each disposed at a position between the keycap corresponding thereto and the substrate, and each further having a protrusion with a central axis line to be formed at a position corresponding to the at least one first electric conductor of one of the plural first conductor units corresponding thereto; and a plurality of supporting elements, each disposed at a position between the keycap corresponding thereto and the substrate while movably connecting to the keycap corresponding thereto and the substrate for enabling the corresponding keycap to move up and down relative to the substrate;

wherein, when one of the plural keycap is subjected to a first force, the protrusion of the pressed keycap is enabled to move along its central axis line and thus engage with the thin film switch so as to enable the first thin film and the second thin film to move toward each other, and thus enable the at least one first electric conductor of the first conductor unit that is disposed corresponding to the pressed keycap to engage with the second electric conductor at the first position for constructing an electrical conduction, and when one of the plural keycap is subjected to a second force, the protrusion of the pressed keycap is enabled to move along its central axis line and thus engage with the thin film switch so as to enable the first thin film and the second thin film to move toward each other, and thus enable the at least one first electric conductor of the first conductor unit that is disposed corresponding to the pressed keycap to engage simultaneously with the second electric conductors at the first and the second positions of one corresponding second conductor unit for constructing another electrical conduction.

18. The keyboard of claim 17, wherein in addition to the second electric conductors that are disposed respectively at the first and the second positions on the second thin film, there is further another second electric conductor that is selected from the plural second conductors of the second conductor unit to be disposed at a third position on the second thin film while enabling the third position to be spaced from the first position by a second distance that is not equal to the first distance; and thereby, the at least one first electric conductor is enabled to engage simultaneously with the second electric conductors at the first, the second and the third positions for constructing further another electrical conduction when a third force is exerted upon the thin film switch for causing the first thin film and the second thin film to move toward each other.

19. The keyboard of claim 18, wherein the second electric conductor disposed at the first position is a circular-shaped component, while the second electric conductors disposed at the second and the third positions are both arc-shaped component, and thereby, the two arc-shaped second electric conductors are arranged concentric to the circular-shaped second electric conductor.

20. The keyboard of claim 19, wherein the central axis line of the elastic component is arranged passing through the center of the circular-shaped second electric conductor.

21. The keyboard of claim 17, wherein the plural second electric conductors are disposed distributing within an area on the second thin film that is corresponding to the at least one first electric conductor of the first conductor unit mounted on the first thin film.

22. The keyboard of claim 17, wherein the amount of the first electric conductors in the first conductor unit is equal to that of the second electric conductors, and the plural first electric conductors are disposed corresponding to the plural second electric conductors in an one-on-one manner.

23. The keyboard of claim 17, wherein the first and the second thin films are respectively being formed with circuits, that can be electrically conducted as soon as the at least one first electric conductor is enabled to engaged with the plural second electric conductors.

24. The keyboard of claim 17, further comprising:

a spacer layer, arranged between the first thin film and the second thin film, having a hole formed thereon to be used for allowing the at least one first electric conductor to cross therethrough so as to engage with the plural second electric conductors for construction the electrical conduction when the first thin film and second thin film are forced to move toward each other.

25. The keyboard of claim 17, wherein the supporting element is substantially a scissors-type supporting part, configured by the use of a first and a second pivot axes that are coupled to each other while enabling one end of the first pivot axis to moveably coupled to the keycap and another end of the first pivot axis opposite thereto to moveably coupled to the substrate, and simultaneously enabling one end of the second pivot axis to moveably coupled to the keycap and another end of the second pivot axis opposite thereto to moveably coupled to the substrate; and thereby, the elastic component is received inside the scissors-type supporting part.

* * * * *